US011828443B2

(12) United States Patent
Cheng et al.

(10) Patent No.: US 11,828,443 B2
(45) Date of Patent: Nov. 28, 2023

(54) TOOL-FREE LIGHT BOX

(71) Applicant: CHANGZHOU LINTEL DISPLAY CO., LTD, Changzhou (CN)

(72) Inventors: Xiaofeng Cheng, Changzhou (CN); Zhantao Liang, Changzhou (CN)

(73) Assignee: CHANGZHOU LINTEL DISPLAY CO., LTD, Changzhou (CN)

( * ) Notice: Subject to any disclaimer, the term of this patent is extended or adjusted under 35 U.S.C. 154(b) by 115 days.

(21) Appl. No.: 17/618,492

(22) PCT Filed: Jun. 10, 2020

(86) PCT No.: PCT/CN2020/095259
§ 371 (c)(1),
(2) Date: Dec. 12, 2021

(87) PCT Pub. No.: WO2020/248991
PCT Pub. Date: Dec. 17, 2020

(65) Prior Publication Data

US 2022/0235923 A1 Jul. 28, 2022

(30) Foreign Application Priority Data

Jun. 14, 2019 (CN) ..... 201910513823.7

(51) Int. Cl.
*F21V 21/06* (2006.01)
*F21V 17/12* (2006.01)
(Continued)

(52) U.S. Cl.
CPC ..... *F21V 21/06* (2013.01); *F21V 17/12* (2013.01); *F21V 17/164* (2013.01); *F21V 23/002* (2013.01); *F21V 23/06* (2013.01)

(58) Field of Classification Search
CPC ..... G09F 13/0413; G09F 13/0445; G09F 13/0446; G09F 13/0447; G09F 13/0456;
(Continued)

(56) References Cited

U.S. PATENT DOCUMENTS 3,426,367 A * 2/1969 Bradford ..... A61G 1/013 5/628
3,517,905 A * 6/1970 Nestegard ..... G09F 1/12 40/607.1
(Continued)

FOREIGN PATENT DOCUMENTS

CN 106764608 A * 5/2017
CN 108305569 A * 7/2018
(Continued)

OTHER PUBLICATIONS

CN-106764608-A (Year: 2017).*
(Continued)

*Primary Examiner* — Peggy A Neils
*Assistant Examiner* — James M Endo
(74) *Attorney, Agent, or Firm* — Bayramoglu Law Offices LLC

(57) ABSTRACT

A tool-free light box is provided. Specifically, a top profile, a bottom profile, and vertical rod profiles are spliced on the periphery to form a closed frame. Each profile is provided with two or more hollow cavities, and each end portion of the profile is provided with two or more round holes. An inner wall of the profile is provided with a notch connected to a wiring profile, and a wire passes through a hollow cavity of the wiring profile. Two ends of the wire are connected to a conductive insertion hole, and the conductive insertion hole is embedded into an end portion of the wiring profile. A connector is arranged between the profiles, and the connector is provided with a protruding end. The protruding
(Continued)

end is inserted into the hollow cavity of the profile, and a lug boss is arranged on the protruding end.

8 Claims, 5 Drawing Sheets

(51) Int. Cl.
*F21V 17/16* (2006.01)
*F21V 23/00* (2015.01)
*F21V 23/06* (2006.01)

(58) Field of Classification Search
CPC ..... G09F 13/049; G09F 13/0418; G09F 2013/1872; G09F 2013/1877; G09F 2013/1881; F21V 15/01; F21V 15/012; F21V 15/015; F21V 23/06; F21V 23/002; F21V 23/001; F21V 21/005; F21V 21/34; F21V 21/12; F21W 2131/405; F21S 4/20; F21S 4/22; F21S 4/24; F21S 4/26
See application file for complete search history.

(56) References Cited

U.S. PATENT DOCUMENTS 3,556,569 A * 1/1971 Bruhn ..... B62D 33/044 403/230
4,085,789 A * 4/1978 Steiner ..... A47G 5/00 160/351
4,348,127 A * 9/1982 Hays, Jr. ..... A47G 1/10 403/402
4,734,051 A * 3/1988 Burns ..... H01R 13/703 439/819
4,862,612 A * 9/1989 Sugihara ..... A47G 1/101 403/402
4,878,303 A * 11/1989 Banniza ..... G09F 13/00 40/607.1
5,590,974 A * 1/1997 Yang ..... A47B 47/005 403/171
5,906,064 A * 5/1999 Field ..... G09F 7/08 40/607.1
6,042,243 A * 3/2000 Grill ..... G09F 13/0413 40/605
6,523,986 B1 * 2/2003 Hoffmann ..... E04F 19/02 362/374
6,702,453 B2 * 3/2004 Weedon ..... F21V 23/002 362/225
7,069,679 B2 * 7/2006 Haggard, Jr. ..... G09F 7/12 40/604
7,144,139 B2 * 12/2006 Kramer ..... E04F 19/06 362/240
7,401,946 B2 * 7/2008 Laukhuf ..... F21S 4/28 439/502
9,470,385 B1 * 10/2016 Ploucher ..... F21S 4/28
2002/0118537 A1 * 8/2002 Segretto ..... F21V 15/013 362/240
2009/0021936 A1 * 1/2009 Stimac ..... F21S 2/005 362/249.02
2014/0233232 A1 * 8/2014 Radermacher ..... F21S 2/005 362/249.01
2015/0016149 A1 * 1/2015 Cohade ..... F21V 17/10 362/646
2017/0276332 A1 * 9/2017 Pearson ..... F21V 21/005

FOREIGN PATENT DOCUMENTS

CN 108305569 A 7/2018
CN 109410792 A * 3/2019
CN 109410792 A 3/2019
CN 109473049 A * 3/2019
CN 109473049 A 3/2019
CN 109854997 A * 6/2019
CN 109854997 A 6/2019
CN 110189653 A 8/2019
DE 20110439 U1 10/2001

OTHER PUBLICATIONS

CN-109410792-A (Year: 2019).*
CN-109473049-A (Year: 2019).*
CN-109854997-A (Year: 2019).*
CN-108305569-A (Year: 2018).*

* cited by examiner

TOOL-FREE LIGHT BOX

CROSS REFERENCE TO THE RELATED APPLICATIONS

This application is the national phase entry of International Application No. PCT/CN2020/095259, filed on Jun. 10, 2020, which is based upon and claims priority to Chinese Patent Application No. 201910513823.7, filed on Jun. 14, 2019, the entire contents of which are incorporated herein by reference.

TECHNICAL FIELD

The present invention relates to a light box, and more particularly, to a tool-free light box.

BACKGROUND

Light box is a type of equipment generally used in the advertising industry. The splicing light box, due to the detachable feature, is singularly flexible, which means it can be quickly assembled, and quickly disassembled. Moreover, it can be standardized to form a larger light box through splicing as needed, without increasing the overall type of the profile. Specifically, it is only required to adjust the number of connectors according to a customer's on-site conditions, so as to achieve the standardization and flexibility.

In terms of the traditional light box, the assembling needs to use screwdrivers and other tools, and even need to open holes on site, which is relatively inconvenient. In view of this, some skilled have developed a type of light box without tools, which uses a locking device to press and connect the profile. Although this locking device solves the problem of "tool-free", it, in essence, just uses a tool embedded in the profile to replace the solid tool, which does not mean being completely tool-free.

In order to achieve a complete tool-free assembly without adding a large number of embedded parts, and achieve cost savings and firmed assembling, the connectors in the prior art must be optimized.

In addition, in the traditional light box, the installation of the light pipe and the wire has not been optimized, the light pipe may be clamped on the profile and the wire may be tied to the profile, so that the scene is excessively chaotic, not beautiful, and unreliable, so in the tool-free light box, it should be taken into account the tool-free assembly of the light pipe.

SUMMARY

In order to solve the problem of achieving the complete tool-free assembly of the light box, and to realize the synchronous tool-free assembly of the light pipe and the light box, an optimized technical solution of a tool-free light box is provided, as follows:

A tool-free light box is provided. Specifically, a top profile, a bottom profile, and vertical rod profiles are spliced on a periphery to form a closed frame. Each profile is provided with two or more hollow cavities, and each end portion of the profile is provided with two or more the round holes. The inner wall of the profile is provided with a notch connected to the wiring profile, and a wire passes through a hollow cavity of the wiring profile. Two ends of the wire are respectively connected to a conductive insertion hole, and the conductive insertion hole is embedded into an end portion of the wiring profile. A connector is arranged between the profiles, and the connector is provided with a protruding end. The protruding end is inserted into the hollow cavity of the profile, and a lug boss is arranged on the protruding end. The inside of the lug boss is provided with an elastomer, such as a spring, which can eject the lug boss, so that the lug boss is snap-fitted into the round hole, maintaining the ejecting and fastening state without loosening, so as to achieve the butt-joint purpose. The lug boss is snap-fitted into the round hole. The connector is further provided with the butt-joint conductive column, and the conductive column is matched with the conductive insertion hole for conduction. A hole is provided in the profile of the light box, and the wire is led out of the hole and connected to a power adapter and a plug. A light bar is embedded into notches of inner walls of the top profile, the bottom profile, and the vertical rod profiles.

The profile may be a profile of a polyvinyl chloride (PVC) plastic or other commonly used profile with a certain rigidity.

The light bar is arranged in the desired position, and the shape of the light bar is similar to that of the wiring profile. Since the position of the light bar does not need to be arranged by wiring, the wiring profile and the light bar can share one position of the rectangular notch in a way of replacing each other. Generally, the light bar can be set on the inner walls of the top profile and the bottom profile, while the wiring profile can be set on the inner walls of the vertical rod profiles. Alternatively, the position of the light bar may be flexibly set as needed. Various methods of tool-free connection of the light bar and the circuit of the present invention all fall within the scope of protection of the present invention.

Preferably, profiles on the same straight line are formed by splicing a plurality of profiles through a straight connector. In this way, the plurality of profiles can be combined and spliced in a straight line to extend the length of a straight profile and make the set more flexible.

Preferably, the top profile or the bottom profile is spliced with the vertical rod profiles by a right-angle connector. The right-angle connector plays a role of a splicing component of the profile, and also has a connecting function of the circuit. In this way, the socket direction of the butt-joint conductive column inside the right-angle connector is also 90 degrees, thus realizing the 90-degree adapting of the circuit.

Preferably, a slot is formed on a vertical surface of the straight connector, and a middle transverse supporting rod is arranged between the vertical rod profiles. Two ends of the middle transverse supporting rod are provided with a clamping block, and the clamping block is clamped into the slot for connection. The middle transverse supporting rod can play the role of strengthening and fixing the vertical rod profiles, especially in a large and high light box. Since the straight connector as a standard part is provided with the slot, the positions where the middle transverse supporting rod can be added are integrated. In this way, the middle transverse supporting rod can be arranged at all the positions or the necessary positions as needed.

Further, the clamping block is a rectangular block, and one corner of the rectangular block is a round corner. In use, the clamping block of the middle transverse supporting rod is hung into the slot from the round corner, and then the middle transverse supporting rod is rotated. Due to the existence of the round corner and the right angle, an interference occurs after rotation, so that the clamping block is firmly clamped in the slot, which realizes the tool-free connection.

Preferably, two ends of the middle of the straight connector are provided with the butt-joint conductive column. The conductive column may be a low-voltage conductive male plug, and the upper and lower positions of the conductive column abut against each other internally for transmitting electricity up and down.

Preferably, an outer opening of the lug boss is a slope surface, and an inner opening of the lug boss is a right angle. One end of the lug boss being inserted into the plastic profile has the slope surface, which makes it prone to insert the plastic profile, and the other end is the right angle, which makes it not prone to come off. This makes the setting more firmed.

Preferably, according to the cross section of the profile, a trapezoidal notch is formed in a center of an outer wall of the profile, a rectangular notch is formed at two ends of the outer wall of the profile, a rectangular notch is formed in a center of the inner wall of the profile, and an arc transition surface is formed from the outer wall to the inner wall of the profile. Specifically, the trapezoidal notch in the center of the outer wall is configured to connect the supporting foot, while the rectangular notch of the two ends of the outer wall is a cloth-clamping notch for clamping a decorative cloth.

Preferably, a supporting foot is connected under the bottom profile, a trapezoidal block is arranged on the supporting foot, and the trapezoidal block is rotatably installed on the supporting foot and inserted into the trapezoidal notch of the outer wall of the bottom profile. The addition of the trapezoidal notch on the profile can be used as an additional structure to increase the stiffness of the profile, and the use of this trapezoidal notch can also achieve a reliable tool-free connection between the supporting foot and the profile. The trapezoid block is rotatably installed on the supporting foot, so that the angle of the supporting foot is more suitable for the standing of the light box by rotation, that is, the supporting foot can be adjusted appropriately according to the condition of the ground, to be either parallel or angled. Thus, the simple arrangement achieves the multiple functions.

Preferably, a light-reflecting concave and convex stripe structure is arranged on two sides of the rectangular notch of the inner wall of the profile, and on the arc transition surface from the outer wall to the inner wall of the profile. The stripe structure on the transition surface achieves a light-reflecting effect.

Advantage:

1. The light box of the present invention includes a profile assembly, a right-angle connector, a straight connector, a middle transverse connecting rod assembly, and a supporting foot assembly, and the assembling of the complete set does not need tool and is portable. The combination and splicing of the module can also be achieved as a large-specification display light box.

2. The light box of the present invention realizes the integrated tool-free connection of the circuit, the wire and the profile, which is beautiful and firmed.

Figure 1:
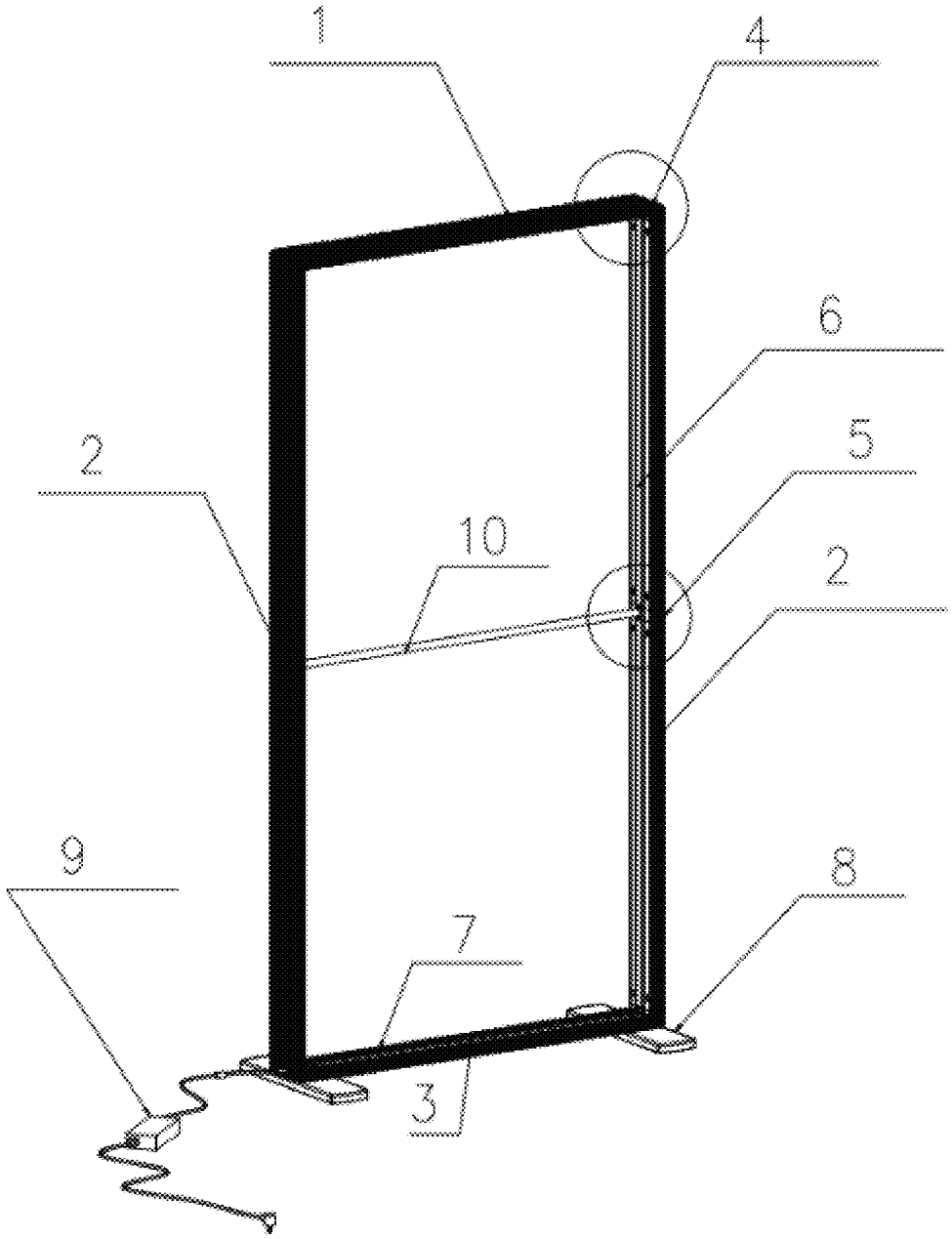
FIG. 1 is an overall schematic diagram of the present invention.
Figure 2:
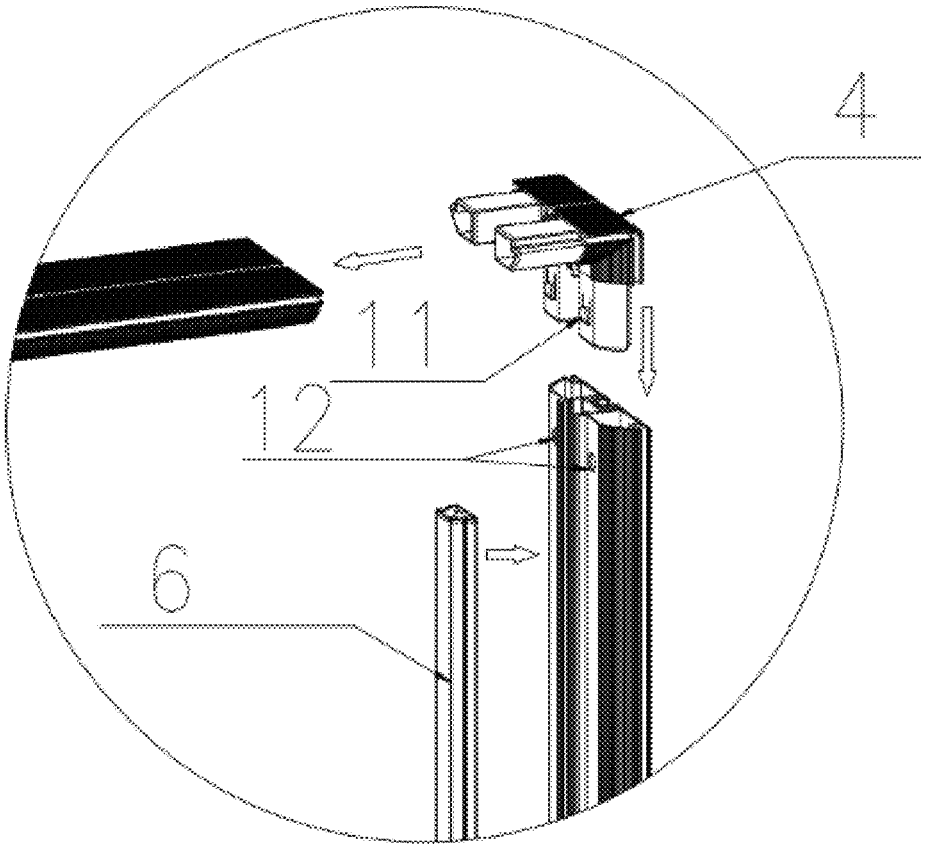
FIG. 2 is a schematic diagram of a right-angle connector.
Figure 3:
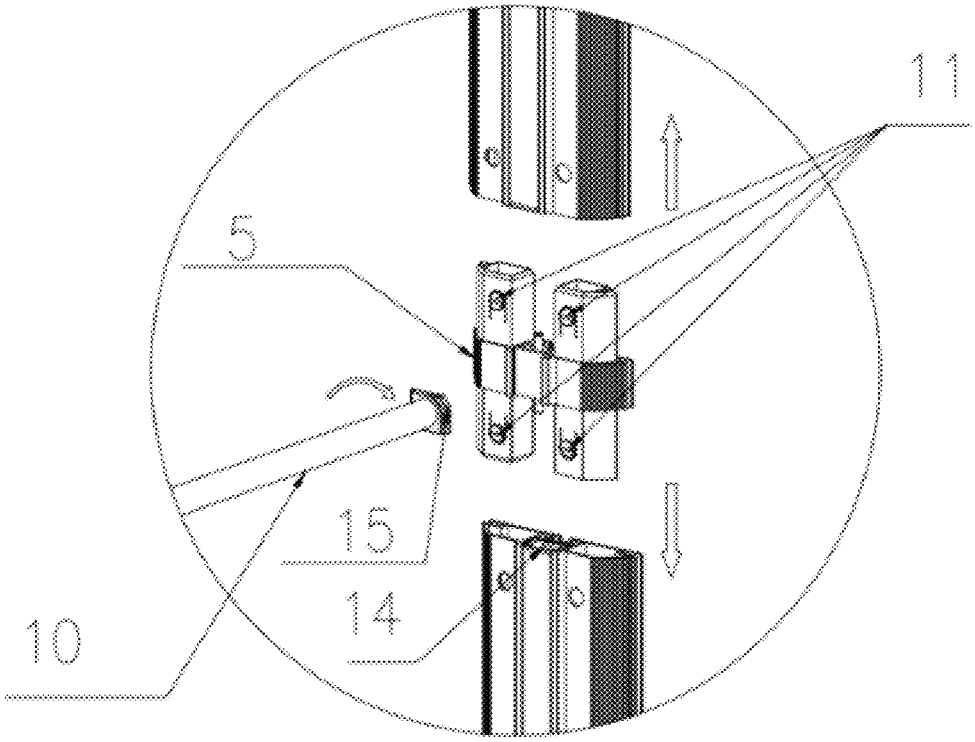
FIG. 3 is a schematic diagram of a straight connector.
Figure 4:
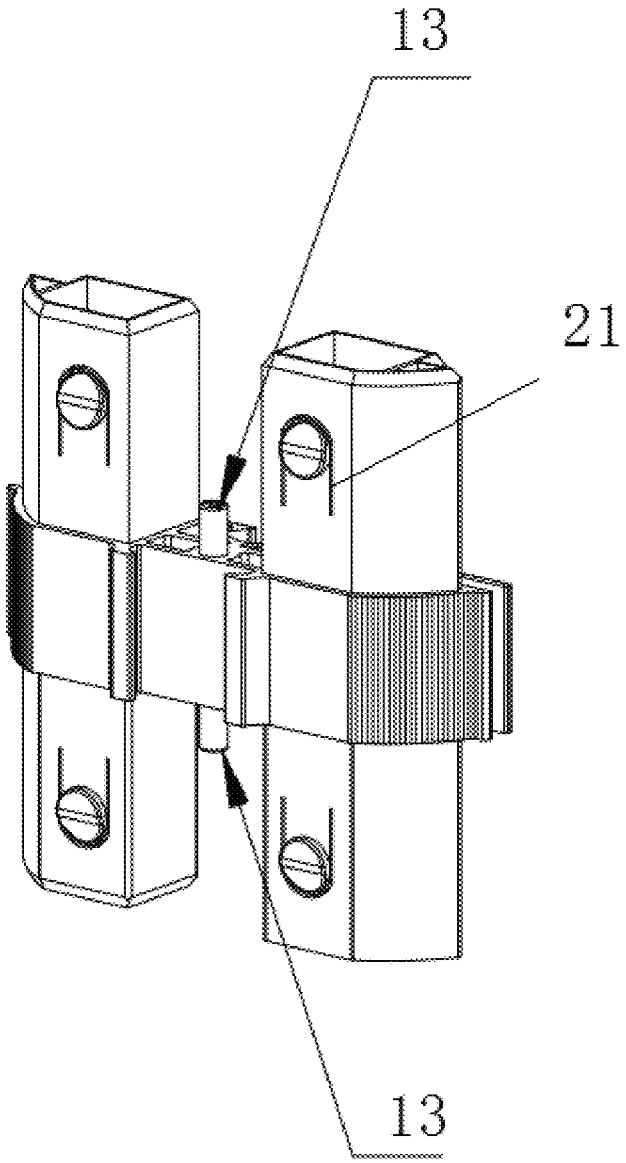
FIG. 4 is an enlarged diagram of a straight connector.
Figure 5:
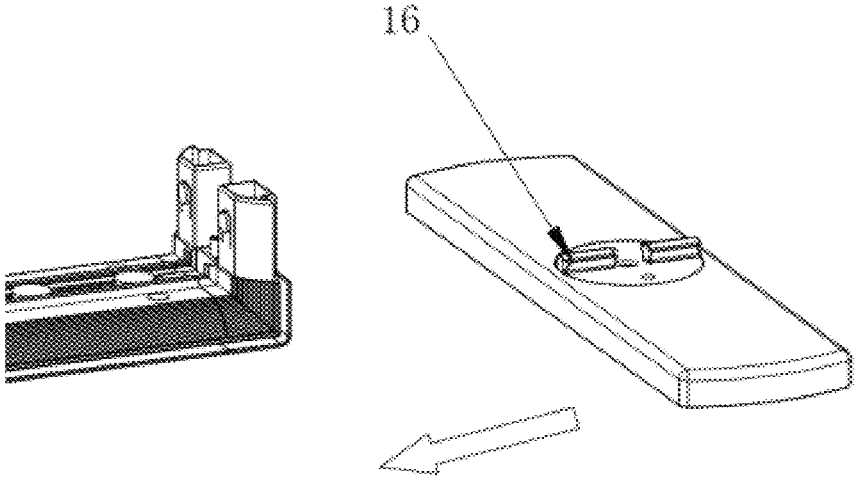
FIG. 5 is a schematic diagram showing the connection of a supporting foot.
Figure 6:
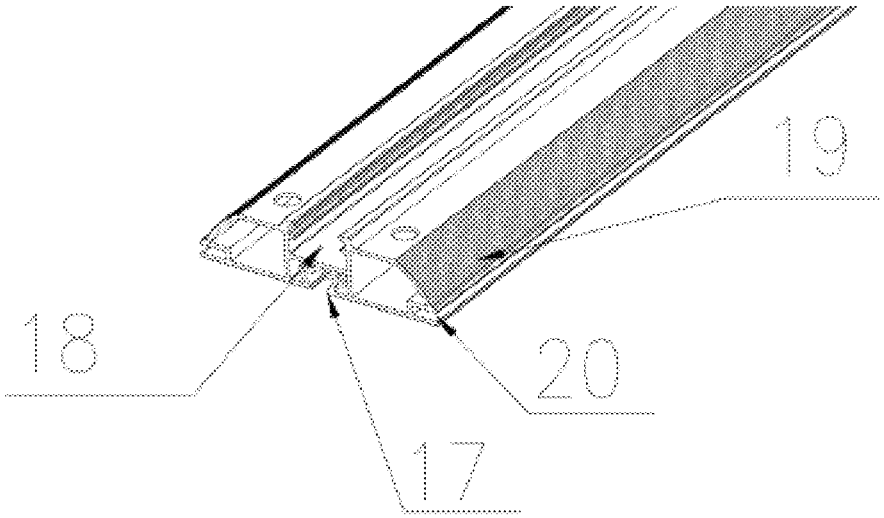
FIG. 6 is a schematic diagram of a cross section of a profile.

In the figures: 1—top profile, 2—vertical rod profile, 3—bottom profile, 4—right—angle connector, 5—straight connector, 6—wiring profile, 7—light bar, 8—supporting foot, 9—power adapter, 10—middle transverse supporting rod, 11—lug boss, 12—round hole, 13—conductive column, 14—conductive insertion hole, 15—round corner, 16—trapezoidal block, 17—trapezoidal notch, 18—rectangular notch (wiring notch), 19—transition surface (light-reflecting stripe), 20—cloth—clamping notch, 21—elastomer.

DETAILED DESCRIPTION OF THE EMBODIMENTS

In an embodiment, a tool-free light box is illustrated with reference to the drawings. Specifically, the top profile 1, the bottom profile 3, and the vertical rod profiles 2 are spliced on a periphery to form a closed frame. Each profile is provided with two or more hollow cavities, and each end portion of the profile is provided with two or more the round holes 12. The inner wall of the profile is provided with a notch connected to the wiring profile 6, and a wire passes through a hollow cavity of the wiring profile 6. Two ends of the wire are respectively connected to the conductive insertion hole 14, and the conductive insertion hole 14 is embedded into an end portion of the wiring profile 6. A connector is arranged between the profiles, and the connector is provided with a protruding end. The protruding end is inserted into the hollow cavity of the profile, and the lug boss 11 is arranged on the protruding end. The inside of the lug boss 11 is provided with the elastomer 21, which can eject the lug boss 11, so that the lug boss 11 is snap-fitted into the round hole 12, maintaining the ejecting and fastening state without loosening, so as to achieve the butt-joint purpose. The connector is further provided with the butt-joint conductive column 13, and the conductive column 13 is matched with the conductive insertion hole 14 for conduction. The round hole 12 is provided in the profile of the light box, and the wire is led out of the round hole 12 and connected to the power adapter 9 and a plug. The light bar 7 is embedded into notches of inner walls of the top profile 1, the bottom profile 3, and the vertical rod profiles 2. The light bar 7 is arranged in the rectangular notches 18 of the inner walls of the top profile 1 and the bottom profile 3, while the wiring profile 6 is arranged in the rectangular notches 18 of the vertical rod profiles 2.

The top profile or the bottom profile is spliced with the vertical rod profiles by the right-angle connector 4. The straight connector 5 is configured to splice the profiles in a straight line, and a slot is formed on the straight connector 5. The middle transverse supporting rod 10 is arranged between the vertical rod profiles. The two ends of the middle transverse supporting rod 10 are provided with a clamping block, and the clamping block is clamped into the slot for connection. The middle transverse supporting rod 10 is arranged between every two straight connectors 5 on the left and right. The clamping block is a rectangular block, and one corner of the rectangular block is a round corner.

Two ends of the middle of the straight connector 5 are provided with the butt-joint conductive column 13. The conductive column 13 is a low-voltage conductive male plug, and the upper and lower positions of the conductive column 13 abut against each other internally for transmitting electricity up and down.

An outer opening of the lug boss 11 is a slope surface, and an inner opening of the lug boss 11 is a right angle.

According to the cross section of the profile, the trapezoidal notch 17 is formed in the center of the outer wall of the profile, the rectangular notch 20 is formed at two ends of the outer wall of the profile, the rectangular notch 18 is formed in the center of the inner wall of the profile, and the arc transition surface 19 is formed from the outer wall to the inner wall of the profile.

The supporting foot 8 is connected under the bottom profile 3, and the trapezoidal block 16 is arranged on the supporting foot 8. The trapezoidal block 16 is rotatably installed on the supporting foot 8 and inserted into the trapezoidal notch 17 of the outer wall of the bottom profile 3.

A light-reflecting concave and convex stripe structure is arranged on two sides of the rectangular notch 20 of the inner wall of the profile, and on the arc transition surface 19 from the outer wall to the inner wall of the profile, achieving light-reflecting effect.

What is claimed is:

1. A tool-free light box, comprising frame profiles including a top profile, a bottom profile, and vertical rod profiles, wherein said frame profiles are spliced on a periphery to form a closed frame; wherein each of the profiles is provided with two or more hollow cavities, and each end portion of the profiles is provided with two or more round holes; an inner wall of each of the profiles is provided with a notch connected to a wiring profile, and a wire passes through a hollow cavity of the wiring profile; two ends of the wire are connected to a conductive insertion hole, and the conductive insertion hole is embedded into an end portion of the wiring profile; wherein at least one of the frame profiles includes a plurality of sub-profiles that are spliced through a straight connector, and the connector is provided with a protruding end; the protruding end is inserted into a hollow cavity of the two or more hollow cavities of the sub-profiles, and a lug boss is arranged on the protruding end; an inside of the lug boss is provided with an elastomer; the lug boss is snap-fitted into a round hole of the two or more round holes; the connector is further provided with a butt-joint conductive column, and the butt-joint conductive column is matched with the conductive insertion hole for a conduction of electricity with the conductive insertion hole; a wire hole is provided in the frame profiles of the light box, and the wire is led out of the wire hole and connected to a power adapter and a plug; and light bars are embedded into a notch of the inner wall of the top profile, a notch of the inner wall of the bottom profile, and notches of the inner wall of the vertical rod profiles, wherein a slot is arranged on a vertical surface of the straight connector, and a middle transverse supporting rod is arranged between the vertical rod profiles; each of two ends of the middle transverse supporting rod is provided with a clamping block, and the clamping block is clamped into the slot for a connection, wherein the clamping block is a rectangular block and one corner of the rectangular block is a round corner and wherein the clamping block is configured such that rotation of the clamping block in the slot causes an interference between the slot and the round corner together with a vertex of the rectangular block and clamps the clamping block in the slot.

2. The tool-free light box according to claim 1, further comprising a frame connector, which splices the top profile or the bottom profile is spliced with the vertical rod profiles, wherein the frame connector is a right-angle connector.

3. The tool-free light box according to claim 1, wherein two ends of a middle of the straight connector are provided with the butt-joint conductive column.

4. The tool-free light box according to claim 1, wherein according to a cross section of each of the frame profiles, a trapezoidal notch is formed in a center of an outer wall of each of the frame profiles, a first rectangular notch is formed at two ends of the outer wall of each of the frame profiles, a second rectangular notch is formed in a center of the inner wall of each of the frame profiles, and an arc transition surface is formed from the outer wall of each frame profile to the inner wall of each of the frame profiles.

5. The tool-free light box according to claim 4, wherein a supporting foot is connected under the bottom profile, a trapezoidal block is arranged on the supporting foot, the trapezoidal block is rotatably installed on the supporting foot, and the trapezoidal block is inserted into the trapezoidal notch of the outer wall of the bottom profile for a connection.

6. The tool-free light box according to claim 4, wherein a light-reflecting concave and convex stripe structure is arranged on each of two sides of the second rectangular notch of the inner wall of each of the frame profiles, and on the arc transition surface from the outer wall of each of the frame profiles to the inner wall of each of the frame profiles.

7. The tool-free light box according to claim 1, wherein two ends of a middle of the straight connector are provided with a respective butt-joint conductive column.

8. The tool-free light box according to claim 5, wherein a light-reflecting concave and convex stripe structure is arranged on each of two sides of the second rectangular notch of the inner wall of each of the frame profiles, and on the arc transition surface from the outer wall of each of the frame profiles to the inner wall of each of the frame profiles.

* * * * *